US005456847A

United States Patent [19]

Guth et al.

[11] Patent Number: 5,456,847

[45] Date of Patent: Oct. 10, 1995

[54] LOW FOAMING, NONSILICONE AQUEOUS TEXTILE AUXILIARY COMPOSITIONS AND THE PREPARATION AND USE THEREOF

[75] Inventors: Christian Guth, Birsfelden, Switzerland; Albert Stehlin, Rosenau, France

[73] Assignee: Ciba-Geigy Corporation, Ardsley, N.Y.

[21] Appl. No.: 171,887

[22] Filed: Dec. 22, 1993

Related U.S. Application Data

[63] Continuation of Ser. No. 8,246, Jan. 21, 1993, abandoned, which is a continuation of Ser. No. 712,848, Jun. 10, 1991, abandoned.

[30] Foreign Application Priority Data

Jun. 11, 1990 [CH] Switzerland ..... 1945/90
Mar. 8, 1991 [CH] Switzerland ..... 709/91

[51] Int. Cl.[6] ..... D06M 13/165

[52] U.S. Cl. ..... 252/8.9; 252/8.6; 252/DIG. 1; 252/174.21; 252/174.22; 524/317; 568/607; 568/613; 568/625

[58] Field of Search ..... 568/607, 613, 568/625; 524/317; 252/8.6, 8.9, DIG. 1, 174.21, 174.22

[56] References Cited

U.S. PATENT DOCUMENTS

| | | | |
|---|---|---|---|
| 3,539,519 | 11/1970 | Weimer | 252/89 |
| 4,207,421 | 6/1980 | Scardera et al. | 568/625 |
| 4,340,766 | 2/1982 | Klahr et al. | 368/625 |
| 4,612,352 | 9/1986 | Schaefer et al. | 525/404 |
| 4,622,173 | 11/1986 | Broze et al. | 252/DIG. 1 |
| 4,624,803 | 11/1986 | Balzer et al. | 252/DIG. 1 |
| 4,661,279 | 4/1987 | Parker | 252/DIG. 1 |
| 4,780,237 | 10/1988 | Schmid | 252/DIG. 1 |
| 4,826,618 | 5/1989 | Borseth et al. | 252/174.21 |
| 4,832,865 | 5/1989 | Krivak et al. | 252/DIG. 1 |
| 4,836,951 | 6/1989 | Totten et al. | 252/174.21 |
| 4,844,710 | 7/1989 | Guth | 8/127.1 |
| 4,861,342 | 8/1989 | Danel | 8/444 |
| 4,898,992 | 2/1990 | Stankowiak et al. | 568/618 |
| 4,922,029 | 5/1990 | Birnbach et al. | 568/616 |
| 4,925,587 | 5/1990 | Schenker et al. | 252/DIG. 1 |
| 4,956,115 | 9/1990 | Van De Mark | 252/170 |
| 5,002,686 | 3/1991 | Guth et al. | 252/174.16 |
| 5,049,303 | 9/1991 | Secemski et al. | 252/DIG. 1 |
| 5,074,888 | 12/1991 | Topfl et al. | 8/543 |

FOREIGN PATENT DOCUMENTS

| | | |
|---|---|---|
| 0299691 | 1/1989 | European Pat. Off. . |
| 0406168 | 1/1991 | European Pat. Off. . |
| 0420802 | 4/1991 | European Pat. Off. . |

OTHER PUBLICATIONS

Emulsifiers and Detergents (1993) p. 78 no month available.
Igepal® Nonionic Surfactants (1992) p. 1 no month available.

*Primary Examiner*—Paul Lieberman
*Assistant Examiner*—Michael Tierney
*Attorney, Agent, or Firm*—Kevin T. Mansfield

[57] ABSTRACT

There are disclosed low foaming, nonsilicone aqueous textile auxiliary compositions comprising (a) a reaction product of a nonionic surfactant of formula $$R-O-(\text{alkylene}-O)_p R_1, \quad (1)$$

wherein

R is an aliphatic radical of at least 8 carbon atoms, $R_1$ is hydrogen, $C_1$–$C_8$alkyl, a cycloaliphatic radical of at least 5 carbon atoms, lower alkylphenyl or styryl, "alkylene" denotes an alkylene radical of 2 to 4 carbon atoms, and p is an integer from 2 to 60, with a compound which contains an acid water-solubilising group, (b) a nonionic surfactant of formula (1), and, optionally, (c) a hydrotropic agent.

These textile auxiliary compositions are suitable for use as dispersants and for wetting and/or washing fibre materials.

9 Claims, No Drawings

LOW FOAMING, NONSILICONE AQUEOUS TEXTILE AUXILIARY COMPOSITIONS AND THE PREPARATION AND USE THEREOF

This application is a continuation of application Ser. No. 08/008,246, filed Jan. 21, 1993, abandoned, which is a continuation of application Ser. No. 07/712,848, filed Jun. 10, 1991, abandoned.

The present invention relates to to low foaming, nonsilicone aqueous textile auxiliary compositions, to their preparation and to the versatile use thereof as wettings agents, detergents, dispersants or as stabilisers in peroxide bleaching liquors.

The low foaming, nonsilicone aqueous textile auxiliary compositions comprise (a) a reaction product of a nonionic surfactant of formula $$R-O\left(\text{alkylene}-O\right)_p R_1, \quad (1)$$

wherein R is an aliphatic radical of at least 8 carbon atoms, $R_1$ is hydrogen, $C_1$–$C_8$alkyl, a cycloaliphatic radical of at least 5 carbon atoms, lower alkylphenyl or styryl, "alkylene" denotes an alkylene radical of 2 to 4 carbon atoms, and p is an integer from 2 to 60, with a compound which contains an acid water-solubilising group, (b) a nonionic surfactant of formula (1), and, optionally, (c) a hydrotropic agent.

The substituent R in formula (1) is conveniently the hydrocarbon radical of an unsaturated or saturated aliphafic monoalcohol of 8 to 22 carbon atoms. The hydrocarbon radical may be straight chain or branched. Preferably R is an alkyl or alkenyl radical of 9 to 14 carbon atoms.

Lower alkyl denotes hydrocarbon radicals which contain 1 to 5, preferably 1 to 4, carbon atoms. Such groups are typically: methyl, ethyl, n-propyl, isopropyl, n-butyl, sec-butyl, tert-butyl, amyl, isoamyl or tert-amyl.

The aliphatic saturated monoalcohols which may be suitably used are typically lauryl alcohol, myristyl alcohol, cetyl alcohol or stearyl alcohol, as well as synthetic alcohols such as 2-ethylhexanol, 1,1,3,3-tetramethylbutanol, 2-octunol, isononyl alcohol, trimethylhexanol, trimethylnonyl alcohol, decanol, $C_9$–$C_{11}$oxoalcohol, tridecyl alcohol, isotridecanol or linear primary alcohols (Alfols) of 8 to 18 carbon atoms. Some representatives of these Alfols are Alfol (8–10), Alfol (9–11), Alfol (10–14), Alfol (12–13) or Alfol (16–18). ("Alfol" is a registered trademark).

Illustrative examples of unsaturated monoalcohols are dodecenyl alcohol, hexadecenyl alcohol or oleyl alcohol.

The alcohol radicals may be single or in the form of mixtures of two or more components, such as mixtures of alkyl and/or alkenyl groups which are derived from soybean fatty acids, palm nut fatty acids or tallow oils.

$(\text{Alkylene-O})_p$ chains are preferably of the ethylene glycol, ethylene propylene glycol or ethylene isopropylene glycol type; p is preferably 4 to 20.

Illustrative examples of nonionic surfactants from which component (a) is prepared are:

polyadducts of preferably 2 to 60 mol of alkylene oxides, preferably ethylene oxide, individual ethylene oxide units of which polyadducts can be replaced by substituted epoxides, such as isopropylene oxide and/or propylene oxide, with higher unsaturated or saturated fatty alcohols of 8 to 22 carbon atoms.

Interesting nonionic surfactants suitable as component (a) have the formula $$R-O\left(CH_2-CH_2-O\right)_{n_1}\left(\underset{Y_1}{CH}-\underset{Y_2}{CH}-O\right)_{m_1}R_1, \quad (2)$$

wherein one of $Y_1$ and $Y_2$ is methyl or ethyl and the other is hydrogen, $n_1$ is an integer from 2 to 40, $m_1$ is an integer from 0 to 15, and R and $R_1$ are as defined for formula (1).

Particularly interesting nonionic surfactants are those of formula $$R_2-O\left(CH_2-CH_2-O\right)_{n_2}\left(\underset{Y_3}{CH}-\underset{Y_4}{CH}-O\right)_{m_2}R_3, \quad (3)$$

wherein $R_2$ is $C_9$–$C_{14}$alkyl, $R_3$ is hydrogen, $C_1$–$C_4$alkyl, a cycloaliphatic radical of at least 6 carbon atoms or benzyl, one of $Y_3$ and $Y_4$ is hydrogen or methyl and the other is hydrogen, $n_2$ is an integer from 0 to 8, and $n_2$ is an integer from 4 to 10.

Further important nonionic surfactants are those of formula $$R_2-O\left(CH_2-CH_2-O\right)_{n_3}\left(\underset{Y_5}{CH}-\underset{Y_6}{CH}-O\right)_{m_3}R_4, \quad (4)$$

wherein $R_2$ is as defined for formula (3), $R_4$ is hydrogen, $C_1$–$C_4$alkyl or lower alkylphenyl, one of $Y_5$ and $Y_6$ is hydrogen and the other is ethyl, $n_3$ is an integer from 4 to 8, and $m_3$ is an integer from 1 to 3.

The preparation of the surfactants of formulae (1) to (4) is carried out in a manner which is known per se, conveniently by reacting the corresponding alkylene oxide polyadducts with thionyl chloride and subsequently reacting the resultant chlorinated compound with a short-chain cycloaliphatic alcohol, fatty alcohol, lower alkylphenyl alcohol or styryl alcohol.

Acid water-solubilising groups from which component (a) is obtained are typically carbonyl and/or sulfonic acid groups. Suitable acids are ethylenically unsaturated polymerizable carboxylic or sulfonic acids. Monocarboxylic acids and dicarboxylic acids and anhyfides thereof as well as sulfonic acids may suitably be used, each of which acids contains an ethylenically unsaturated aliphatic radical and preferably not more than 7 carbon atoms. The monocarboxylic acids are typically acrylic acid, methacrylic acid, α-haloacrylic acid, 2-hydroxyethylacrylic acid, α-cyanoacrylic acid, crotonic acid and vinylacetic acid. Ethylenically unsaturated dicarboxylic acids are preferably fumaric acid, maleic acid or itaconic acid, and also mesaconic acid, citraconic acid, glutaconic acid and methylmalonic acid. The preferred anhydride of these acids is maleic anhydride.

Sulfonic acids as defined herein are conveniently vinylsulfonic acid or 2-acrylamido-2-methylpropanesulfonic acid.

Monocarboxylic acids of 2 to 5 carbon atoms are preferred, especially methacrylic acid and, most preferably, acrylic acid.

Interesting compounds suitable for use as component (a) are those obtained from 5 to 50% by weight of a nonionic surfactant of formula (1) and 95 to 50% by weight of acrylic acid.

Among these compounds, those compounds are particularly preferred which have been obtained from a nonionic surfactant of formula (3).

The compounds eligible for use as component (a) of the compositions of this invention are prepared by methods which are known per se, conveniently by combining first the appropriate nonionic surfactant with at least 20% by weight, based on the final product, of an ethylenically unsaturated compound which contains acid water-solubilising groups, for example an appropriate carboxylic acid or an anhydride thereof or a sulfonic acid, and carrying out the reaction in the presence of a catalyst, preferably in the temperature range from 60° to 100° C.

The catalyst is preferably an initiator which forms free radicals. Illustrative examples of suitable initiators for carrying out the reaction are symmetrical aliphatic azo compounds such as azobisisobutyronitrile, azobis(2-methylvaleronitrile), 1,1'-azobis(1-cyclohexanitrile) and alkyl 2,2'-azobisisobutyrate, symmetrical diacyl peroxides, such as acetyl, propionyl or butyryl peroxide, benzoyl peroxide, bromine-, nitro-, methyl- or methoxy-substituted benzoyl peroxides as well as lauroyl peroxide; symmetrical peroxydicarbonates such as diethyl, diisopropyl, dicyclohexyl and dibenzyl peroxydicarbonate; tert-butyl peroctoate, tert-butyl perbenzoate or tert-butylphenyl peracetate as well as peroxycarbamates such as tert-butyl-N-(phenylperoxy)carbamate or tert-butyl-N-(2,3-dichloro- or-4-chlorophenylperoxy-)carbamate. Further suitable peroxides are: tert-butylhydroperoxide, di-tert-butylperoxide, cumene hydroperoxide, dicumene peroxide and tert-butyl perpivalate. A further suitable compound is potassium persulfate, which is preferably used in the present invention.

The catalysts are normally used in amounts of 0.1 to 10 % by weight, preferably 0.5 to 2% by weight, based on the starting products.

It is advantageous to carry out the reaction in an inert atmosphere, conveniently in a nitrogen atmosphere.

The nonionic surfactants used as component (b) of the composition of this invention correspond to those of component (a) according to formulae (1) to (4).

The following compounds may suitably be used as optional component (c) of the composition of the invention:

alkali metal salts and amine salts of $C_1$–$C_{10}$alkylphosphoric acid esters;

diols, for hexylene glycol;

sulfonates of terpenoids or mono- or binuclear aromatic compounds, for example the sulfonates of camphor, toluene, xylene, cumene and naphthol;

alkali metal salts and amine salts of saturated or unsaturated $C_3$–$C_{12}$di- or polycarboxylic acids, for example of malonic, succinic, glutaric, adipic, pimelic, suberic, azelaic and sebacic acid, of undecanedicarboxylic and dodecanedicarboxylic acid, of fumaric, maleic, tartaric and malic acid as well as citric and aconitic acid.

2-Ethylhexyl sulfate is especially preferred.

Preferred textile auxiliary compositions are those wherein component (a) is a compound which has been obtained from a nonionic surfactant of formula (1) and acrylic acid, component (b) is a nonionic surfactant of formula (1), and the optional component (c) is 2-ethylhexyl sulfate.

Further eligible important textile auxiliary compositions are those wherein component (a) is a compound which has been obtained from a nonionic surfactant of formula (3), and component (b) is a nonionic surfactant of formula (3).

The textile auxiliary compositions of this invention can be prepared by simple stirring of components (a), (b) and optionally (c).

The compositions are preferably prepared by mixing components (a), (b) and optionally (c), with stirring, and adding deionised water until a homogeneous solution is obtained.

Preferred textile auxiliary compositions of the invention most conveniently comprise, based on the entire composition, 2 to 22% of component (a), 10 to 95% of component (b), to 15% der component (c), and water to make up 100%.

The novel compositions are low foaming, nonsilicone and not APEO-containing textile auxiliaries. Owing to their liquid form, they are easy to handle and are therefore particularly suitable for modern metering devices. They have a multipurpose utility and are consequently suitable for different end use requirements. They can be used conveniently as wetting agents, textile detergents, dispersants or as stabilisers in peroxide bleaching liquors.

Accordingly, the invention also relates to a process for wetting and/or washing fibre materials, wherein said materials are treated in aqueous medium and in the presence of a textile auxiliary composition comprising (a) a reaction product of a nonionic surfactant of formula $$R-O-(\text{alkylene}-O)_p R_1, \quad (1)$$

wherein R is an aliphatic radical of at least 8 carbon atoms, $R_1$ is hydrogen, $C_1$–$C_8$-alkyl, a cycloaliphatic radical of at least 5 carbon atoms, lower alkylphenyl or styryl, "alkylene" denotes an alkylene radical of 2 to 4 carbon atoms, and p is an integer from 2 to 60, with a compound which contains an acid water-solubilising group, (b) a nonionic surfactant of formula (1), and, optionally, (c) a hydrotropic agent.

The amounts in which the textile auxiliary composition of the invention is added to the treatment liquors are from 0.1 to 30 g/liter, preferably from 0.2 to 10 g/liter, of treatment liquor. These liquors may contain further ingredients, such as alesizing agents, dyes, fluorescent whitening agents, synthetic resins and alkalies such as sodium hydroxide.

Suitable fibre materials are: cellulose, especially nonpretreated natural cellulose such as hemp, linen, jute, viscose staple, viscose, acetate rayon, natural cellulose fibres and, preferably, raw cotton, wool, polyamide, polyacrylonitfile or polyester fabrics and blends, for example polyacrylonitrile/cotton or polyester/cotton blends.

The fibre material can be in any form of presentation, for example the cellulosic material may be in the form of loose stock, yarn, woven or knitted goods. The material is thus usually always in the form of textile materials which are made from pure cellulosic textile fibres or from blends of cellulosic textile fibres with synthetic textile fibres. The fibre material can be treated continuously or batchwise in aqueous liquor.

The aqueous treatment liquors can be applied to the fibre materials in known manner, conveniently by impregnation on the pad to a pick-up of ca. 70–120 % by weight. The pad method is used especially in the pad-steam and pad-batch process.

Impregnation can be effected in the temperature range from 10° to 60° C., but preferably at room temperature. After impregnation and expression, the cellulosic material is subjected to an optional heat treatment in the temperature range from 80° to 140° C. The heat treatment is preferably carried out by steaming at 95°–140° C., preferably 100°–106° C. Depending on the nature of the heat development and the temperature range, the heat treatment can take from 30 seconds to 60 minutes. In the pad-batch process, the impregnated goods are rolled up without being dried, packed in a plastic sheet, and stored at room temperature for 1 hour to 24 hours.

The treatment of the fibre materials can also be carried out in long liquors at a liquor to goods ratio of typically 1:3 to 1: 100, preferably 1:4 to 1:25, and at 10° to 100° C., preferably 60° to 98° C., for ca. ¼ to 3 hours under normal conditions, i.e under atmospheric pressure, in conventional apparatus such as a jigger, jet or a winchbeck. If desired, the heat treatment can also be carried out in the temperature range up to 150° C., preferably from 105° to 140° C., under pressure in HT (high-temperature) apparatus.

If the process makes it necessary, the fibre materials are subsequently thoroughly rinsed with hot water of 90°–98° C. and then with warm and, finally, cold water, if appropriate neutralised, and then dried at elevated temperature.

In the following Examples percentages are always by weight.

Preparation of the Textile Auxiliary Compositions

EXAMPLE 1

The auxiliary compositions A, B and C are prepared by stirring the components listed in the following Table.

| Auxiliary composition | A | B | C |
|---|---|---|---|
| nonionic surfactant of formula $R-O-(CH_2CH_2O)_{\overline{10}}$ but ($R=C_{9/11}$alkyl) | 20 | 25 | 20 |
| reaction product of a nonionic surfactant of formula $R-O-(CH_2CH_2O)_{\overline{10}}$ but ($R=C_{9/11}$alkyl) and acrylic acid | | | 50 |
| potassium salt of a phosphate ester | 5 | | 5 |
| reaction product of the polyadduct of 1 mol of a $C_9$–$C_{11}$ fatty alcohol and 9 mol of ethylene oxide with acrylic acid | 50 | 68 | |
| 2-ethylhexyl sulfate sodium salt | | 7 | |
| water | 25 | | 25 |

Application Examples

EXAMPLE 2

Formulation B of Example 1 is tested for its detergent properties. This is done by washing a polyester/cotton blend, which has been artificially soiled with soot and engine oil, in an ®AHIBA dyeing machine with twist for 30 minutes at 40° C. and at a liquor to goods ratio of 1:25. The amount of active substance is 1 g/l and the pH of the wash liquor is adjusted to 10 with NaOH. At the end of the washing procedure, the fabric is rinsed, hydroextracted and dried.

The detergent properties are determined by measuring the difference in colour between the washed and an unwashed sample according to DIN 6174. The higher the reflectance, the better the detergent effect. The reflectance of the washed sample is 18.5.

EXAMPLE 3

The formulations A, B and C of Example 1 are suitable for use in highly concentrated alkaline stock liquors containing up to 360 g/l of NaOH. After dilution of the storage liquors to the required concentrations, no loss of wetting properties resulting from the alkali concentration can be observed.

EXAMPLE 4

Raw cotton tricot fabric is treated for 30 minutes at 90° C. in a bleach bath which contains the following ingredients:

2 g/l of formulation B 1 g/l of NaOH ( 100% ), and 5 ml/l of $H_2O_2$ (35%).

No troublesome foaming occurs during bleaching. After bleaching, the fabric is washed off hot and neutralised.

The whiteness level is increased from –77 to 56 CIBA-GEIGY whiteness units.

The addition of formulation B results in a substrate of good absorbency being obtained after the bleach.

What is claimed is:

1. A low foaming, nonsilicone aqueous textile auxiliary composition comprising (a) 2 to 22 percent by weight of a reaction product of ($a_1$) a nonionic surfactant with ($a_2$) an ethylenically unsaturated polymerizable sulfonic acid or carboxylic acid or the anhydride thereof, said nonionic surfactant ($a_1$) having the formula $$R_2-O-(CH_2-CH_2-O)_{\overline{n_2}}-(\underset{Y_3}{\underset{|}{CH}}-\underset{Y_4}{\underset{|}{CH}}-O)_{\overline{m_2}}-R_3, \quad (3)$$

wherein $R_2$ is $C_9$–$C_{14}$alkyl, $R_3$ hydrogen, one of $Y_3$ and $Y_4$ is hydrogen or methyl and the other is hydrogen, $m_2$ is an integer from 0 to 8, and $n_2$ is an integer from 4 to 10; (b) 10 to 95 percent by weight of a nonionic surfactant of the formula $$R_2-O-(CH_2-CH_2-O)_{\overline{n_3}}-(\underset{Y_5}{\underset{|}{CH}}-\underset{Y_6}{\underset{|}{CH}}-O)_{\overline{m_3}}-R_4, \quad (4)$$

wherein $R_2$ is $C_9$–$C_{14}$alkyl, $R_4$ hydrogen, $C_1$–$C_4$alkyl or lower alkylphenyl, one of $Y_5$ and $Y_6$ is hydrogen and the other is ethyl, $n_3$ is an integer from 4 to 8, and $m_3$ is an integer from 1 to 3; (c) 0 to 15 percent by weight of 2-ethylhexyl sulfate, and (d) water to make 100%.

2. A textile auxiliary composition according to claim 1, wherein ($a_2$) is an ethylenically unsaturated monocarboxylic acid of 2 to 5 carbon atoms.

3. A textile auxiliary composition according to claim 2, wherein ($a_2$) is methacrylic acid or acrylic acid.

4. A textile auxiliary composition according to claim 3, wherein ($a_2$) is acrylic acid.

5. A textile auxiliary composition according to claim 4, wherein component (a) has been obtained from 5 to 50% by weight of a nonionic surfactant of formula (3) and 95 to 50% by weight of acrylic or methacrylic acid.

6. A process for wetting or washing fibre materials, wherein said materials are treated in an aqueous medium and in the presence of an effective amount of a textile auxiliary composition comprising a) 2 to 22 parts by weight of a reaction product of ($a_1$) a nonionic surfactant with ($a_2$) an ethylenically unsaturated polymerizable sulfonic acid or carboxylic acid or the anhydride thereof, said nonionic surfactant ($a_1$) having the formula $$R_2-O-(CH_2-CH_2-O)_{\overline{n_2}}-(\underset{Y_3}{\underset{|}{CH}}-\underset{Y_4}{\underset{|}{CH}}-O)_{\overline{m_2}}-R_3, \quad (3)$$

wherein $R_2$ is $C_9$–$C_{14}$alkyl, $R_3$ hydrogen, one of $Y_3$ and $Y_4$ is hydrogen or methyl and the other is hydrogen, $m_2$ is an integer from 0 to 8, and $n_2$ is an integer from 4 to 10;

(b) 10 to 95 pans by weight of a nonionic surfactant of the formula $$R_2-O-(CH_2-CH_2-O)_{n_3}-(\underset{Y_5}{CH}-\underset{Y_6}{CH}-O)_{m_3}-R_4, \quad (4)$$

wherein $R_2$ is $C_9$–$C_{14}$alkyl, $R_4$ hydrogen, $C_1$–$C_4$alkyl or lower alkylphenyl, one of $Y_5$ and $Y_6$ is hydrogen and the other is ethyl, $n_3$ is an integer from 4 to 8, and $m_3$ is an integer from 1 to 3, and (c) 0 to 15 percent by weight of 2-ethylhexyl sulfate.

7. A process according to claim 6, wherein said amount effective is 0.1 to 30 g/liter.

8. A process according to claim 7, wherein the fibre material is treated continuously or batchwise.

9. The fibre material treated by a process as claimed in claim 6.

* * * * *